US009883776B2

(12) United States Patent
Jechart et al.

(10) Patent No.: US 9,883,776 B2
(45) **Date of Patent: *Feb. 6, 2018**

(54) BATHTUB MONITORS

(71) Applicant: RJE International, Inc., Irvine, CA (US)

(72) Inventors: Robert Jechart, Irvine, CA (US); Steve Cole, Huntington Beach, CA (US)

(73) Assignee: RJE International, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/205,417

(22) Filed: Jul. 8, 2016

(65) Prior Publication Data

US 2016/0321905 A1 Nov. 3, 2016

Related U.S. Application Data

(63) Continuation-in-part of application No. 14/097,408, filed on Dec. 5, 2013, now Pat. No. 9,427,115.

(51) Int. Cl.
*G08B 23/00* (2006.01)
*A47K 3/00* (2006.01)
(Continued)

(52) U.S. Cl.
CPC ..... *A47K 3/001* (2013.01); *G08B 21/0415* (2013.01); *G08B 21/084* (2013.01); *G08B 21/0461* (2013.01)

(58) Field of Classification Search
CPC .. A47K 3/001; G08B 21/084; G08B 21/0415; G08B 21/08; G08B 21/02; G08B 21/082;
(Continued)

(56) References Cited

U.S. PATENT DOCUMENTS 6,111,510 A * 8/2000 Coffelt, Jr. ..... G08B 21/082 340/539.1
7,330,123 B1 * 2/2008 Grahn ..... G08B 21/082 340/553
(Continued)

FOREIGN PATENT DOCUMENTS

WO WO 2009/109641 A1 9/2009
WO WO 2012/131667 A1 10/2012

OTHER PUBLICATIONS

International Search Report and Written Opinion, from PCT/US2014/068486 with an international filing date of Dec. 4, 2014, dated Mar. 2, 2015, 10 pgs, mailed from the ISA of the USPTO, Alexandria, Virginia, US.
(Continued)

*Primary Examiner* — Anh V La
(74) *Attorney, Agent, or Firm* — Baker & Hostetler LLP

(57) ABSTRACT

Embodiments according to at least some aspects of the present disclosure comprise methods, apparatus, devices, and/or systems pertaining to bathtub monitors that may be configured to sense motion and/or absence of motion, such as motion associated with an occupant of a bathtub. Some example embodiments may be configured to provide local and/or remote alarm(s) upon detection of a potentially unsafe condition, such as an absence of motion of the occupant of a bathtub. In some example embodiments, a bathtub alarm system may comprise an accelerometer to sense movement (or lack of movement) in the tub by sensing changes in gravitational forces within the tub.

17 Claims, 10 Drawing Sheets

(51) Int. Cl.
*G08B 21/04* (2006.01)
*G08B 21/08* (2006.01)

(58) Field of Classification Search
CPC . G08B 21/22; G08B 21/0288; G08B 21/0461
USPC ..... 340/573.1, 573.3, 573.6, 553, 522, 552, 340/540, 541; 367/93, 94, 134
See application file for complete search history.

(56) References Cited

U.S. PATENT DOCUMENTS 8,022,830 B1 9/2011 Yang
9,427,115 B2 * 8/2016 Jechart ..... A47K 3/001
2003/0152133 A1 8/2003 Ellenz
2004/0145465 A1 * 7/2004 Stults ..... G08B 1/08 340/521
2005/0258969 A1 11/2005 Hoenig
2009/0106891 A1 * 4/2009 Klicpera ..... B05B 12/004 4/605
2010/0305903 A1 * 12/2010 Sharpe ..... A47J 31/002 702/176
2012/0050049 A1 * 3/2012 Quinones Caballero ..... G08B 21/08 340/573.6
2012/0296204 A1 * 11/2012 Ismail ..... A61B 5/4312 600/430
2014/0016434 A1 * 1/2014 Turnbull ..... G01V 1/3808 367/21
2015/0107015 A1 4/2015 Ng

OTHER PUBLICATIONS

European Patent Application No. 14866829.6; Partial Search Report; dated Jul. 31, 2017; 10 pages.
European Patent Application No. 14866829.6; Extended Search Report; dated Nov. 6, 2017; 9 pages.

* cited by examiner

ACCELEROMETER TUB MONITOR BLOCK DIAGRAM

MONITOR

REMOTE

BATHTUB MONITORS

CROSS-REFERENCE TO RELATED APPLICATIONS

This application is a continuation-in-part of U.S. application Ser. No. 14/097,408 filed Dec. 5, 2013, the entire contents of which are expressly incorporated herein in its entirety by reference.

BACKGROUND

The present disclosure contemplates that bathtub overflow alarms have been used to detect water flowing out of a bathtub. Such alarms, however, may not be useful for detecting some potentially unsafe conditions associated with bathtubs, such as drowning, due to their inability to detect conditions not associated with overflowing water.

SUMMARY

The present disclosure pertains to safety monitors, which may comprise alarms, and more particularly, to monitors and/or alarms for small bodies of water such as, for example, bathtubs, whirlpool tubs, medical spas, therapeutic spas, walk-in tubs, 'kiddie' pools, and the like. While the current alarm systems according to the current disclosure are configured to be used with any type of small body of water as described above, the embodiments of the current disclosure will be described for use with bathtubs for simplicity and exemplary purposes. For the purpose of the current claims, the term 'tub' shall include all such water-holding objects for occupancy by a person as described in this paragraph.

Some example embodiments according to at least some aspects of the present disclosure may comprise methods, apparatus, devices, and/or systems pertaining to bathtub monitors that may be configured to sense motion and/or absence of motion, such as motion associated with an occupant of a bathtub. Some example embodiments may be configured to provide local and/or remote alarm(s) upon detection of a potentially unsafe condition, such as an absence of motion of the occupant of a bathtub.

In some example embodiments according to at least some aspects of the present disclosure, a bathtub alarm system may comprise a sonar-based system that may be used, for example, to assist in preventing young children from drowning in a bathtub. The system may be configured to monitor the motion of a child in the bathtub using, for example and without limitation, ultrasound waves generated by a piezoelectric transducer, or by another motion sensor.

In some example embodiments according to at least some aspects of the present disclosure, a bathtub alarm system may comprise a pressure sensor, such as a piezo sensor, to sense movement (or lack of movement) in the tub by sensing pressure waves (or lack of pressure waves) within the tub. In more detailed embodiments, the bathtub alarm system may also include a temperature sensor, such as a thermistor, to sense the bathwater temperature so that the system may be configured to trigger an alarm if the bathwater exceeds a predetermined temperature, such as 100° F.

In some further example embodiments according to at least some aspects of the present disclosure a bathtub alarm system may comprise one or more accelerometers, which may be configured to detect change in gravitational force associated with the motion of an object in the body of water. In more detailed embodiments, the bathtub alarm system may also include a temperature sensor, such as a thermistor, to sense the bathwater temperature so that the system may be configured to trigger an alarm if the bathwater exceeds a predetermined temperature, such as 100° F.

In some example embodiments according to at least some aspects of the present disclosure, a bathtub alarm system may comprise a temperature sensor, exposed to water movement, to sense water movement (or lack of movement) in the tub by sensing voltage changes across the thermistor above an expected (or predetermined) level (such as comparing the voltage changes across a first thermistor exposed to water movement to voltage changes across a second shielded thermistor not exposed to water movement). The second shielded thermistor may also be utilized to sense the bathwater temperature so that the system may be configured to trigger an alarm if the bathwater exceeds a predetermined temperature, such as 100° F.

In some example embodiments, as long as sufficient motion is detected, the system may remain in a "monitor" mode. If no (or little) motion is detected for a predetermined amount of time, the system may initiate an alarm sequence. For example, the system may sound an audible alarm. If substantial motion resumes (e.g., for a preset amount of time), the system may return to the monitor mode. Alternatively, the alarm may be manually silenced by a user.

Some example embodiments according to at least some aspects of the present disclosure may comprise one or more ultrasound (U/S) transducers, which may be configured to transmit and/or create one or more standing waves in a body of water (e.g., a bathtub). The transducers may be configured to detect ultrasound modulated signals when the standing waves are disturbed by the motion of an object (e.g., a person) in the body of water. Some example embodiments according to at least some aspects of the present disclosure may comprise one or more pressure sensors, such as piezo sensors, to sense pressure changes across the sensor caused by movement within the body of water. Some example embodiments according to at least some aspects of the current disclosure may comprise one or more temperature sensors, such as thermistors, to sense changes in local temperature at the sensor due to movement within the body of water.

Some example embodiments according to at least some aspects of the present disclosure may include a central processing unit (e.g., a microprocessor) that may be configured to asses signals from the movement sensor(s). One or more algorithms may be utilized to analyze various parameters to discriminate between "motion" and "no motion" conditions in the bathtub. For example, an alarm signal may be issued based on the outputs of one or more algorithms configured to calculate the timing between different levels of motion strengths that may be associated with movement of a child in the bathtub. Sensors other than piezoelectric and/or thermistor, such as pressure, audio, infra-red, acceleration, floating and other mechanical sensors can also be used with minor modifications to the algorithms.

DETAILED DESCRIPTION

Figure 1:
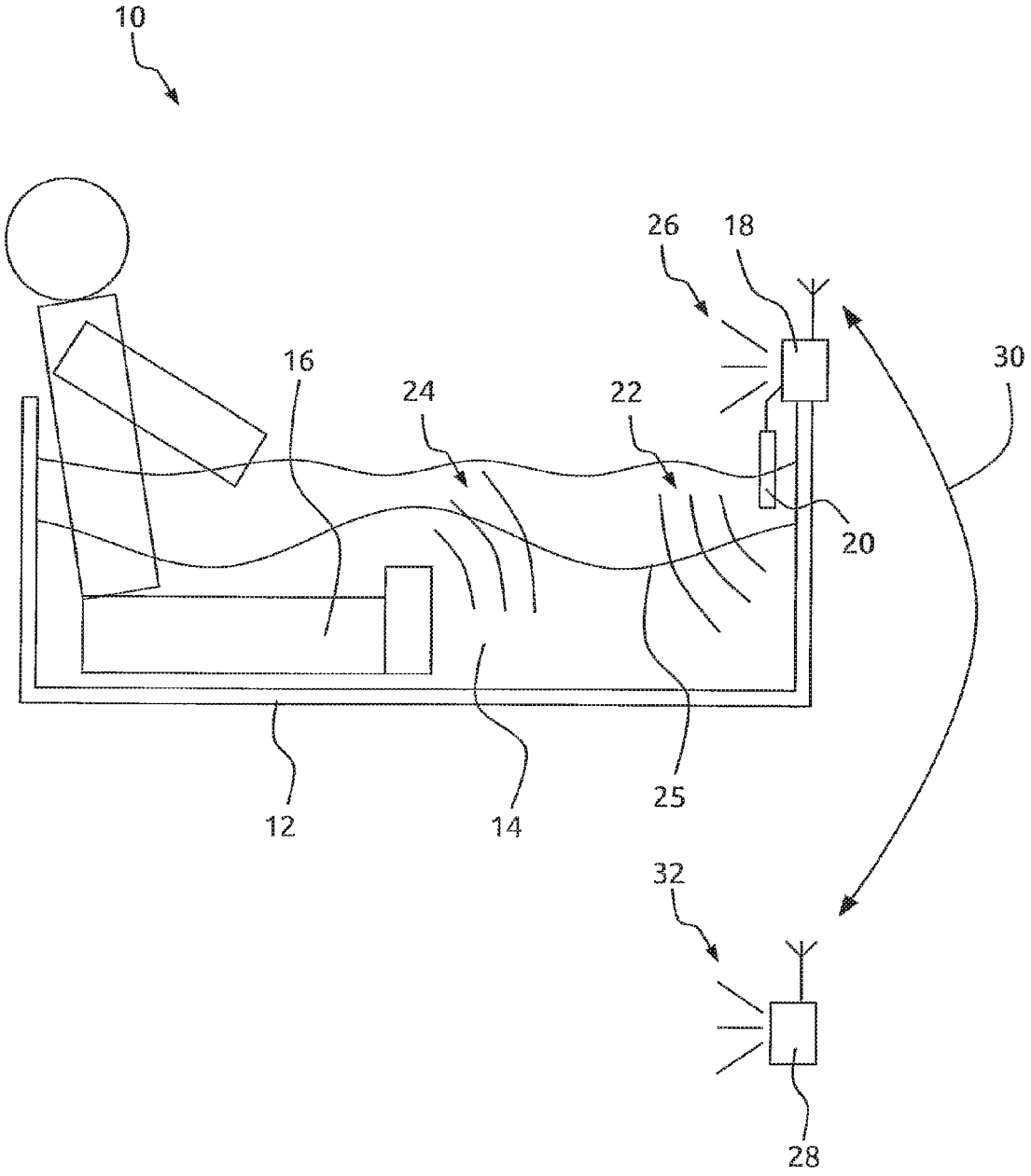
FIG. 1 is a block diagram representation of an exemplary bathtub monitor system and environment according to the current disclosure.

FIG. 1 is a block diagram of an example bathtub monitor system 10 according to at least some aspects of the present disclosure. Bathtub monitor system 10 may be used in connection with a small body of water, such as a bathtub 12, which may contain water 14 and/or an occupant 16. A monitor 18 may be disposed in, at, or near bathtub 12 and/or may include a sensor, such as a transducer 20, operatively associated with water 14 and/or occupant 16. As discussed below, transducer 20 may be configured to emit sound 22 into water 14 and/or may be configured to detect sound 24 in water 14 caused by movement of occupant 16. In some example embodiments, emitted sound 22 may create a standing wave 25 in water 14. In some example embodiments, transducer 20 may be in the form of a piezo sensor configured to sense movement (or lack of movement) in the tub by sensing pressure waves (or lack of pressure waves) within the bathtub 12. In some example embodiments, transducer 20 may be in the form of a thermistor configured to sense changes in temperature at the thermistor that differs from expected temperature changes within the bathtub 12 (i.e., temperature changes attributable to movement in the tub rather than changes attributable to sensed or expected cooling of the bathwater, for example). Monitor 18 may be configured to emit a notification 26, such as an audible alarm. Some example monitors 18 may be configured to communicate with a remote unit 28, such as via a radio link 30. Remote unit 28 may be configured to emit a notification 32, such as an audible alarm.

Figure 2:
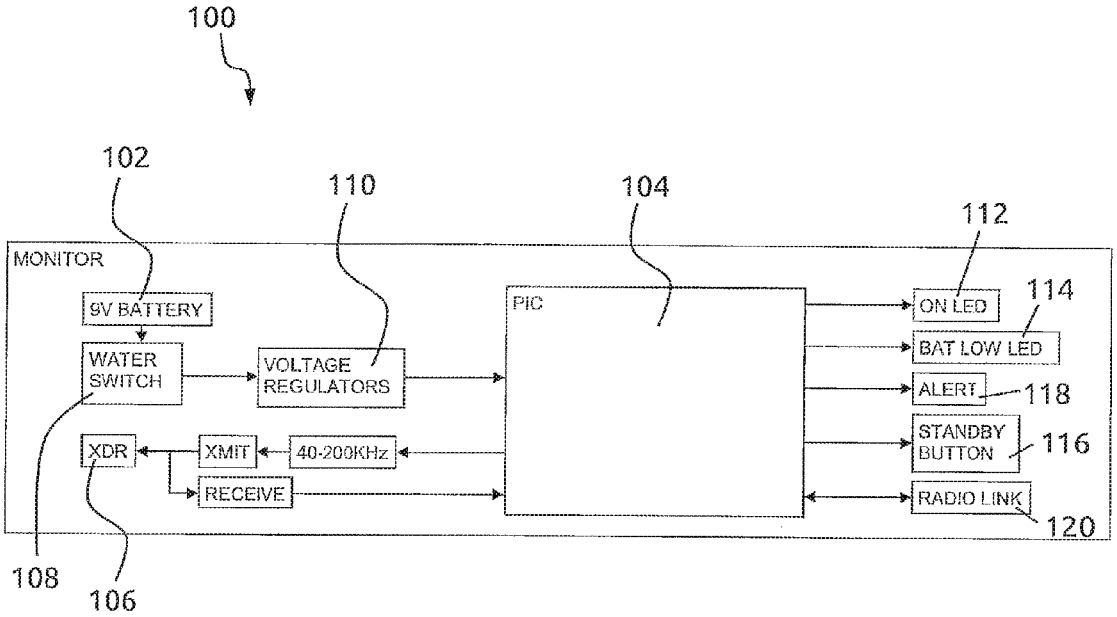
FIG. 2 is a block diagram representation of an exemplary monitoring unit according to the current disclosure.

FIG. 2 is a block diagram of an example monitor unit 100 according to at least some aspects of the present disclosure. Bathtub monitor 100 may include a power source (e.g., battery 102), a microprocessor 104, and/or a transducer 106. In some example embodiments, battery 102 may provide power to microprocessor 104 via a water-activated switch 108 and/or a voltage regulator 110. Microprocessor 104 may transmit and/or receive sound in water 14 using transducer 106, which, during use, may be at least partially immersed in water 14. Microprocessor 104 may include an "on" indication (e.g., ON LED 112), a battery low indication (e.g., BAT LOW LED 114), and/or a standby button 116. Upon detecting certain potentially unsafe conditions, microprocessor 104 may be configured to activate an alert device 118, which may produce one or more visual, audible, tactile, and/or other notifications associated with the detected potentially unsafe condition. For example, alert device 118 may comprise a speaker, buzzer, light, and/or other similar notification devices. Some example embodiments may comprise a radio link 120 (e.g., a transmitter and/or a receiver), which may be configured to transmit notifications (e.g., notifications associated with potentially unsafe conditions) and/or other data (e.g., status messages) to one or more remote locations and/or to receive data (e.g., information and/or commands) from one or more remote locations. For example, commands may active and/or deactivate the bathtub alarm system.

Figure 3:
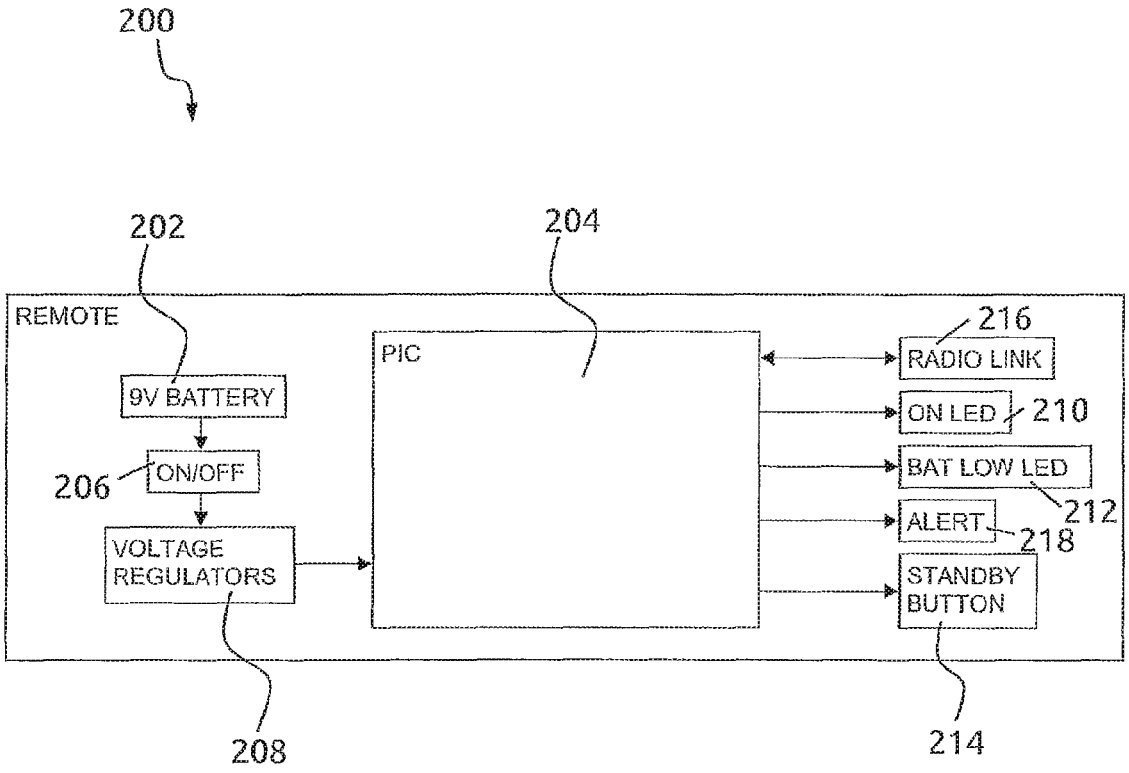
FIG. 3 is a block diagram representation of an exemplary remote unit according to the current disclosure.

FIG. 3 is a block diagram of an example remote unit 200 that may be used in connection with monitor unit 100. Remote unit 200 may comprise a power source (e.g., battery 202) and/or a microprocessor 204. In some example embodiments, battery 202 may provide power to microprocessor 204 via an on/off switch 206 and/or a voltage regulator 208. Remote unit 200 may comprise an "on" indication (e.g., ON LED 210), a low battery indication (e.g., BAT LOW LED 212), and/or a standby button 214.

Remote unit 200 may include a radio link 216 (e.g., a transmitter and/or a receiver) operatively coupled to microprocessor 204. Radio link 216 may be configured to receive notifications (e.g., notifications associated with potentially unsafe conditions) and/or other data (e.g., status messages) from one or more remote locations and/or to transmit data (e.g., information and/or commands) to one or more remote locations. For example, radio link 216 of remote unit 200 may be configured to communicate with radio link 120 of monitor unit 100. Upon receiving a notification associated with a potentially unsafe condition (e.g., via radio link 216), microprocessor 204 may be configured to activate an alert device 218, which may produce one or more visual, audible, tactile, and/or other notifications associated with the detected potentially unsafe condition.

Some example embodiments according to at least some aspects of the present disclosure may comprise alarm logic programmed to perform methods of determining conditions of "motion" and "no motion" in bodies of water, such as bathtubs. For example, an ultrasound wave may be generated by a piezoelectric transducer (e.g., transducer 106) into the body of water (e.g., water 14 in bathtub 12) to create a standing wave (e.g., standing wave 25), which may act as a carrier wave and/or which may be of a frequency different from the frequency range of motion induced by a child in the water.

In some example embodiments according to the present disclosure, transducer 106 may be configured to detect sound waves associated with motion of the child. The sound waves associated with motion of the child may be filtered out from a carrier wave and/or may be converted to an electrical waveform. The amplitude of this waveform may then be averaged and/or amplified. A comparator may be used to compare this waveform and/or its timing with preset levels that may be associated with different levels of motion (e.g., "strengths") within different periods of time. The microprocessor may then analyze these signals based on one or more algorithms and/or the microprocessor may issue commands that may result in caution beeps and/or full alarms. The microprocessor may also send commands to a wireless remote that may alert a person to the various activities of a child in the bathtub.

In some example embodiments according to at least some aspects of the present disclosure, a microprocessor and/or associated circuitry may be configured to average the electrical waveform associated with the motion of the child to produce an averaged voltage level. For example, the circuit may convert a Doppler frequency (e.g., about 25 Hz) to a voltage ramp that changes level at about a 110 mV per second rate. The microprocessor may sample the ramp voltage about every 200 ms. As long as the sampled voltage exceeds a minimum reference level (e.g., 0.25 V), the monitor may stay in monitor mode. Whenever the sampled voltage drops below the minimum reference level (e.g., 0.25 V), the monitor may start a low level alarm sequence that may escalate to a full alarm, such as over a period of seconds. At any time the sampled voltage exceeds the minimum reference level (e.g., 0.25 V) the alarm sequence may halt and the monitor may return to monitor mode.

The microprocessor and/or associated circuitry may compare the averaged voltage level to a predetermined threshold (e.g., 0.25 V). If the averaged voltage level remains at or above the predetermined threshold, then the microprocessor may assume that there is sufficient motion of the child to remain in monitor mode and not sound an alarm. If the averaged voltage level drops below the predetermined threshold volts and remains below threshold for a predetermined period (e.g., 200 ms), the alarm sequence may be initiated. The alarm sequence may start with a beep at an initial volume and or rate (e.g., low volume and about one beep per second). If motion in the bathtub is not detected, the alarm sequence may continue to an escalated alarm, such as a full-volume, continuous beep. In some example embodiments, the alarm escalation may occur in steps over a period of time, such as a gradual increase in volume and rate over a one minute period in 200 ms steps. If the changing voltage rises above the threshold for a predetermined period of time (e.g., above 0.25 volts for 200 ms), the alarm sequence may stop and the system may return to monitor mode.

Figure 4:
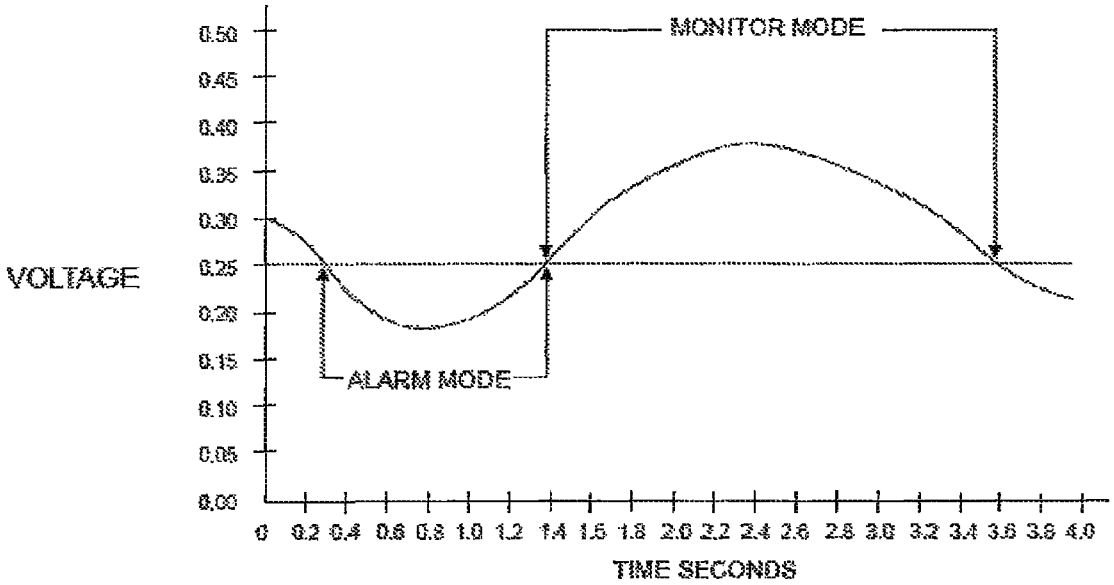
FIG. 4 is an example plot of voltage over time according to an embodiment of the current disclosure.

FIG. 4 is an example plot of voltage over time. As discussed above, when the sampled voltage is below a minimum threshold voltage (e.g., 0.25 V), an example embodiment may be in an alarm mode. When the sampled voltage is above a minimum threshold, (e.g., 0.25 V) an example embodiment may be in a monitor mode.

Figure 5:
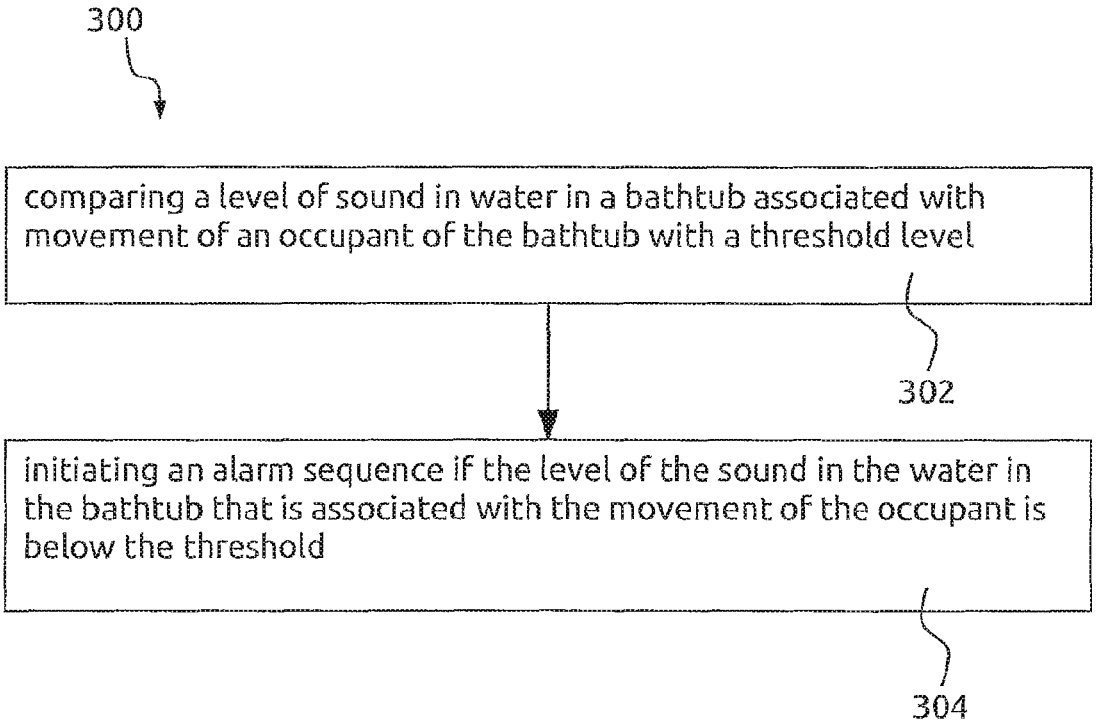
FIG. 5 is a flow chart of an example method of operating a bathtub alarm according to at least some embodiments of the present disclosure.

FIG. 5 is a flow chart of an example method 300 of operating a bathtub alarm according to at least some embodiments of the present disclosure. Method 300 may include an operation 302, which may include comparing a level of sound in water in a bathtub associated with movement of an occupant of the bathtub with a threshold level. Operation 302 may be followed by operation 304, which may include initiating an alarm sequence if the level of the sound in the water in the bathtub that is associated with the movement of the occupant is below the threshold.

Figure 6:
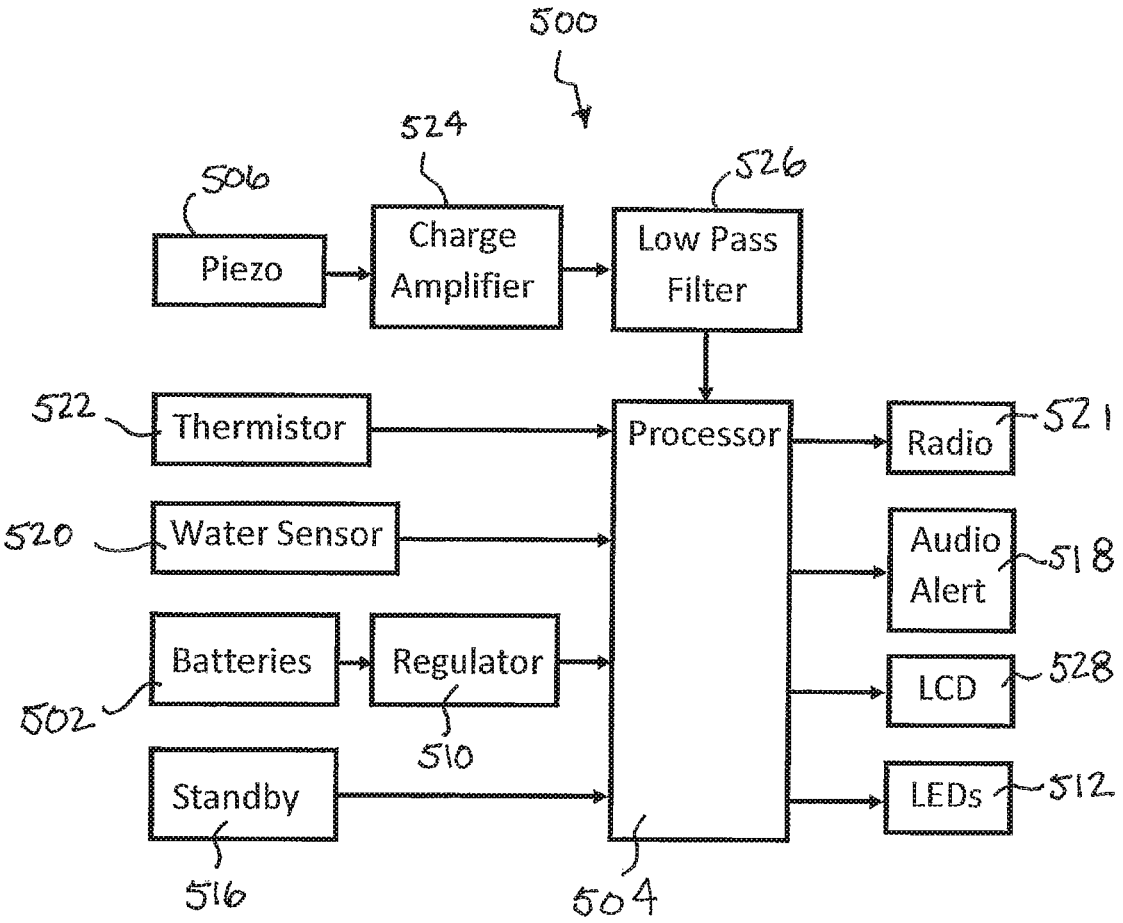
FIG. 6 is a block diagram representation of another exemplary bathtub monitor system according to the current disclosure.
Figure 6:
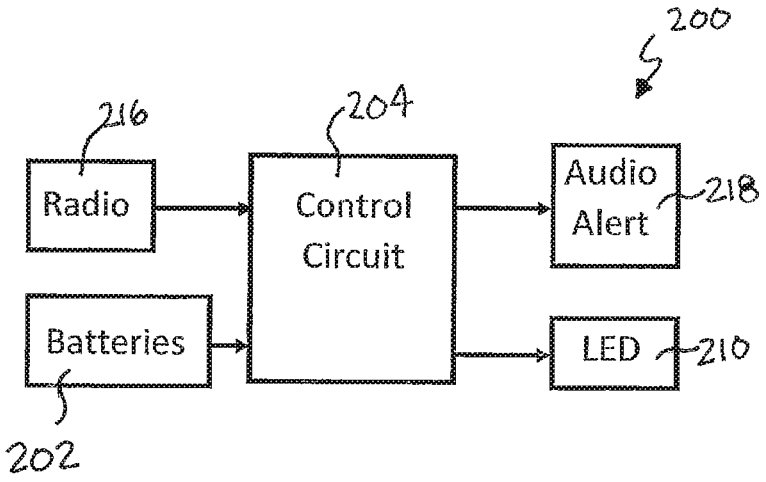

FIG. 6 is a block diagram of another example monitor unit 500 according to at least some aspects of the present disclosure. Bathtub monitor 500 may include a power source (e.g., battery 502), a microprocessor 504, and/or a transducer in the form of a piezo sensor 506. In some example embodiments, battery 502 may provide power to microprocessor 504 via a water-activated switch and/or a voltage regulator 510. Microprocessor 504 may receive sound in water 14 using piezo sensor 506, which, during use, may be at least partially immersed in water 14. Microprocessor may be operatively coupled to a water sensor 520, for sensing that the monitor unit 500 is immersed in water 14, for example; and may be operatively coupled to a thermistor 522 for sensing the temperature of the water 14. Microprocessor 504 may include an "on" indication and/or a "battery low" indication through LEDs 512. Microprocessor may also be operatively coupled to a standby button 516. Upon detecting certain potentially unsafe conditions, microprocessor 504 may be configured to activate an alert device 518, which may produce one or more visual, audible, tactile, and/or other notifications associated with the detected potentially unsafe condition. For example, alert device 518 may comprise a speaker, buzzer, light, and/or other similar notification devices. Some example embodiments may comprise a radio link 521 (e.g., a transmitter and/or a receiver), which may be configured to transmit notifications (e.g., notifications associated with potentially unsafe conditions) and/or other data (e.g., status messages) to one or more remote units 200 and/or to receive data (e.g., information and/or commands) from one or more remote unites 200. For example, commands may active and/or deactivate the bathtub alarm system.

The embodiment of FIG. 6 may operate as follows. A parent may secure the monitor unit 500 to the tub 12 wall via attached suction cups (not shown), for example. As the tub 12 is filled with water 14, the water sensor 520 will detect the water and upon such detection, the processor 504 will turn the monitor 500 on, or activate the monitoring functionalities. When the tub 12 is drained, the sensor 520 may detect the absence of water and cause the processor 504 to turn the monitor 500 off. When the monitor 500 is activated, there may be a delay cycle programmed in before the alarm becomes active (armed). In the meantime, the parent may place the child in the tub 12 (or the child may already be in the tub as the water is filling the tub). Once the monitor 500 arms, activity from the child 16 within the tub may be detected by the piezo sensor 506. As long as the child remains active, the alarm 518 will not sound. If the processor 504 determines that the child's activity has stopped based upon signals from the piezo sensor 506, the processor 504 may be configured to trigger the audio alarm 518 and/or transmit information via radio transmitter 521 to the remote unit 200, which may in response emit an audio alert 218.

As the child plays in the bathtub 12, the child's movements generate small pressure waves. In a detailed exemplary embodiment, as these pressure waves move the piezo sensor 506, the movements generate a series of charges at the input of the charge amplifier 524. The high impedance of the charge amplifier 524 allows these charges to produce a series of pulses. The sensor's capacitance and the high impedance feedback resistor of the charge amplifier 524, create a high pass filter, with a low frequency cut off of 0.59 Hz. The low pass filter 526 has a high frequency cutoff of 3.28 Hz, creating a band pass filter, with a range of 0.59 to 3.28 Hz. The band pass filter allows the processor 504 to look at frequencies generated by the child's movement, and block frequencies not generated by the child. The processor 504 monitors these pulses as movements. When the processor 504 observes a pulse (movement) it resets a 60-second timer. If the processor 504 does not see a pulse/movement within the 60-second time window, it starts an alarm sequence. The alarm sequence is a sequence of beeps (emitted by the audio alert 518, for example) and quiets that increase in volume and frequency as the alarm continues. The alarm is designed to alert the parent with increasing urgency while not scaring the child with a sudden very loud alarm. Depending upon the level of urgency, movement from the child can resent the alarm sequence and return the processor 504 to monitor mode. By pushing the standby button 516, the processor 504 will be in stand-by mode for 60 seconds (monitor 500 is on, but not detecting movement). Pushing the stand-by button 516 during an alarm sequence will reset the alarm sequence and place the monitor 500 in stand-by mode.

In the current embodiment, the monitor 500 may also serve as a thermometer and temperature alarm. A precision thermistor 522 changes resistance according to the temperature of the bathwater 14. The processor 504 monitors this resistance, and displays the associated temperature on an LCD display 528. Further, if the processor 504 senses that a temperature above a predetermined threshold, such as 100° F., the processor 504 may trigger a high temperature alarm to be emitted by the audio alert 518 and/or by the remote unit's 200 audio alert 218. A jumper may be provided to allow the temperature monitor to switch between Fahrenheit and Centigrade measurements.

Figure 7:
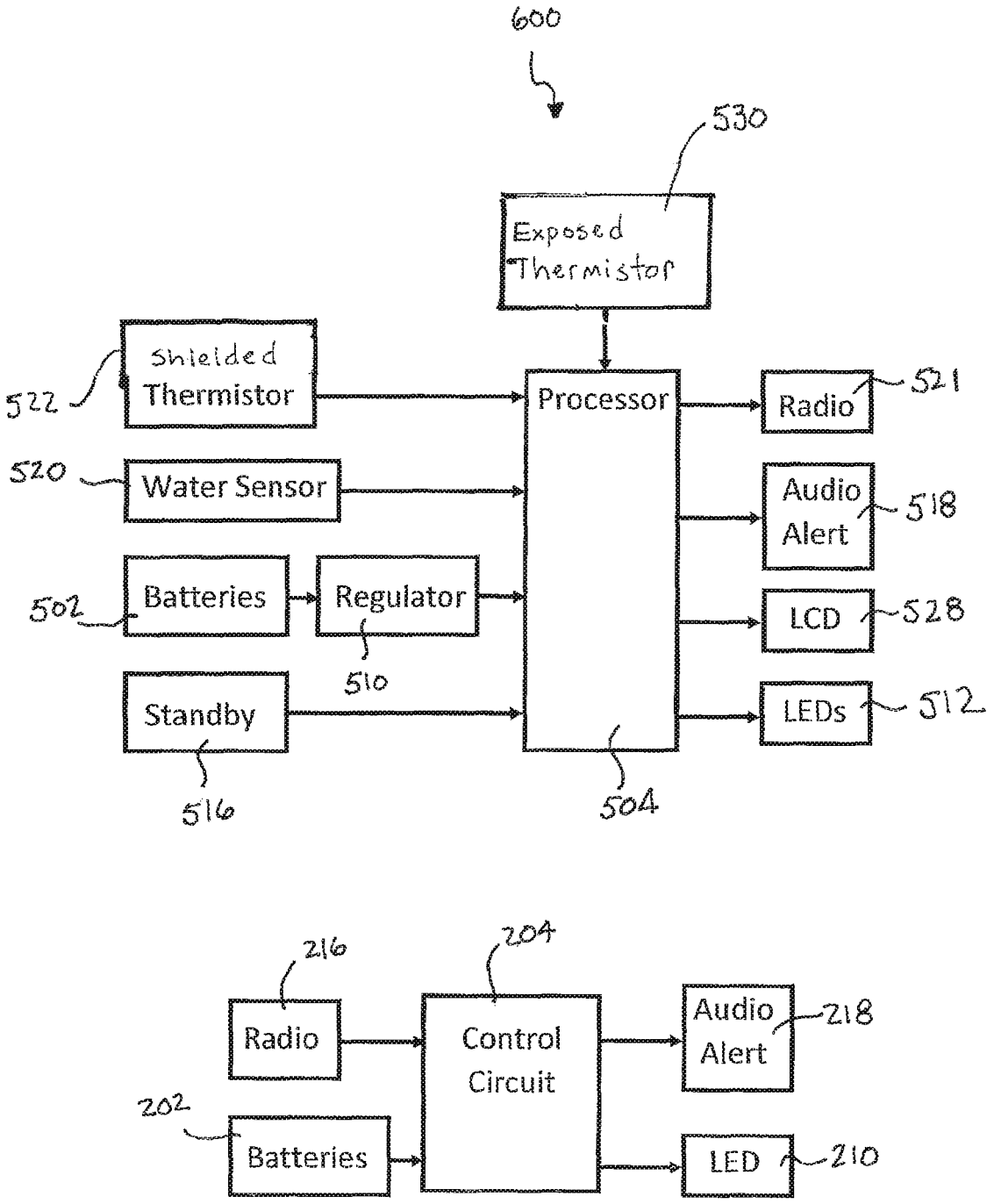
FIG. 7 is a block diagram representation of another exemplary bathtub monitor system according to the current disclosure.

FIG. 7 is a block diagram of another example monitor unit 600 according to at least some aspects of the present disclosure. With the embodiment of FIG. 7, the piezo transducer is replaced with another thermistor 530 to sense movement within the bathwater 14. With this embodiment, there are two thermistors in the tub monitor 600, the shielded or fixed thermistor 522 and the exposed or variable thermistor 530. The shielded thermistor 522 is in the bathwater 14 but shielded from water movement caused by the child taking the bath. The exposed thermistor 530 will be in the bathwater and exposed to water movement. Both thermistors are supplied power by a constant current generator. When the shielded thermistor 522 is active and in the bathwater 14, the only change in resistance will be due to a change in water temperature; and that change will be minimal in many cases as the bathwater will be cooling slowly. When the exposed thermistor 530 is in the bathwater 14 and the constant current generator is on at 5 mA, the thermistor's 530 resistance will reach a stable value which is a balance of the self-heating characteristic and the heat dissipation of the bath water. When the water around the exposed thermistor 530 is moving, from a child in the bathtub 12, this balance is upset and the voltage across the thermistor changes. The processor 504 will be configured to monitor the voltage change across each thermistor to determine if the exposed thermistor 530 is changing more than the shielded thermistor 522, therefore detecting child's movement within the tub 12.

In some example embodiments according to at least some aspects of the present disclosure, one or more sensors other than sound transducers, piezo transducers or thermistor transducers may be used to sense motion of the occupant of the bathtub. For example, alternative sensors include, without limitation, alternate pressure sensors, infra-red sensors, accelerometers, floating sensors, and other similar sensors known in the art. Generally, alternative sensors, such as pressure transducers and moving float sensors, may produce outputs associated with child movement in the tub in the frequency range of about 10 to about 500 Hz. Outputs of amplification and/or filtering circuitry associated with such sensors may be averaged and/or evaluated in generally the same manner as the sound transducer embodiment discussed above.

The present disclosure contemplates that a "false alarm" may occur if the occupant of a bathtub remains substantially still for a period of time. As discussed above, some example embodiments may be configured with an alarm sequence comprising an initial local audible alarm at a relatively low level, which may induce some movement by the occupant of the bathtub. If the induced movement is sufficient to reset the alarm, then then the alarm sequence may be terminated at that point without having escalated to a full alarm and/or without sending a notification to a remote unit. In some example embodiments, initial, low-level alarm notifications may be provided to remote units.

Some example embodiments according to at least some aspects of the present disclosure may be integrated with baby monitor technology, such as to provide audio and/or video monitoring in connection with the motion-based alarms described herein.

In some example embodiments according to at least some aspects of the present disclosure, a standing wave produced by a transducer may have a frequency of about 10 kHz to about 1 MHz. In some example embodiments, a standing wave may have a frequency of about 40 kHz to about 100 kHz.

Some example embodiments according to at least some aspects of the present disclosure may be configured to detect sound associated with movement of an occupant of a body of water of about 10 Hz to about 500 Hz. Some example embodiments may be configured to detect sound associated with movement of an occupant of a body of water of about 10 Hz to about 30 Hz. Some example embodiments may be configured to detect sound associated with movement of an occupant of a body of water of about 25 Hz.

As used herein, "no motion" may refer to conditions in which there may be some motion, but the motion may be below a threshold of detectability. Also, as used herein, "no motion" may refer to conditions in which there may be some detectable motion, but the detected motion may be less than a threshold for consideration as sufficient motion to prevent an alarm.

In some example embodiments according to the present disclosure, accelerometer 531 may be configured to detect gravitational force associated with motion of the child. The gravitational forces associated with motion of the child may be sampled for strength, amplitude, or frequency of change in gravitational force and compared to a predetermined value or may compare this frequency and/or its timing with preset levels that may be associated with different levels of motion (e.g., "strengths") within different periods of time. The microprocessor may then analyze these signals based on one or more algorithms and/or the microprocessor may issue commands that may result in caution beeps and/or full alarms. The microprocessor may also send commands to a wireless remote that may alert a person to the various activities of a child in the bathtub.

In some example embodiments according to at least some aspects of the present disclosure, a microprocessor and/or associated circuitry may be configured to average the gravitational forces associated with the motion of the child to produce an averaged gravitational force level. For example, the circuit may convert gravitational force to gs. The microprocessor may sample gravitational force about every 200 ms. As long as the sampled gravitational force exceeds a minimum reference level (e.g., 0.3 g), the monitor may stay in monitor mode. Whenever the sampled gravitational force drops below the minimum reference level (e.g., 0.3 g), the monitor may start a low level alarm sequence that may escalate to a full alarm, such as over a period of seconds. At any time the sampled gravitational force exceeds the minimum reference level (e.g., 0.3 g) the alarm sequence may halt and the monitor may return to monitor mode.

The microprocessor and/or associated circuitry may compare the averaged gravitational force to a predetermined threshold (e.g., 0.3 g). If the averaged gravitational force remains at or above the predetermined threshold, then the microprocessor may assume that there is sufficient motion of the child to remain in monitor mode and not sound an alarm. If the averaged gravitational force drops below the predetermined threshold gs and remains below threshold for a predetermined period (e.g., 200 ms), the alarm sequence may be initiated. The alarm sequence may start with a beep at an initial volume and or rate (e.g., low volume and about one beep per second). If motion in the bathtub is not detected, the alarm sequence may continue to an escalated alarm, such as a full-volume, continuous beep. In some example embodiments, the alarm escalation may occur in steps over a period of time, such as a gradual increase in volume and rate over a one minute period in 200 ms steps. If the changing gravitational force rises above the threshold for a predetermined period of time (e.g., above 0.3 gs for 200 ms), the alarm sequence may stop and the system may return to monitor mode.

Figure 8:
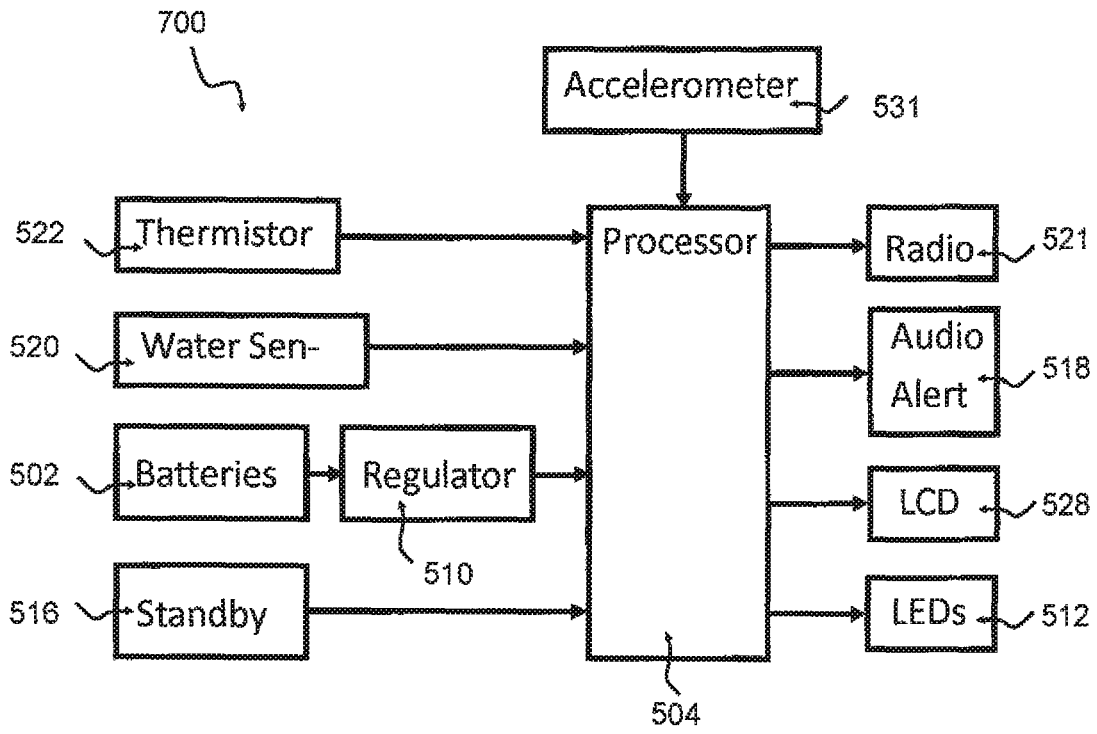
FIG. 8 is a block diagram representation of another exemplary bathtub monitor system according to the current disclosure.
Figure 8:
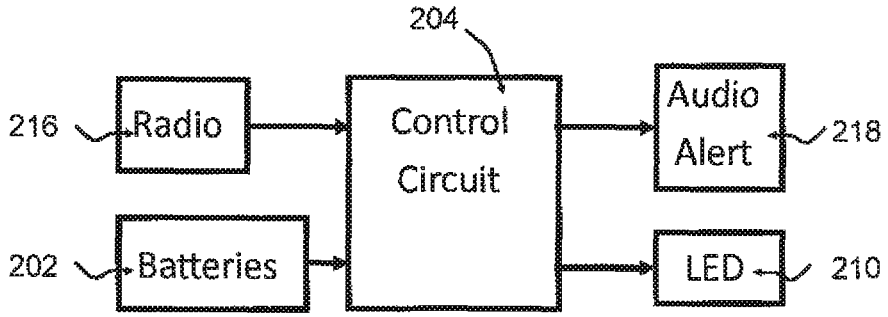

FIG. 8 is a block diagram of another example monitor unit 700 according to at least some aspects of the present disclosure. Bathtub monitor 700 may include a power source (e.g., battery 502), a microprocessor 504, and a accelerometer 531. In some example embodiments, battery 502 may provide power to microprocessor 504 via a water-activated switch and/or a voltage regulator 510. Microprocessor 504 receive gravitational force from movement in water 14 using accelerometer 531, which, during use, may be floating in water 14. Microprocessor may be operatively coupled to a water sensor 520, for sensing that the monitor unit 500 is immersed in water 14, for example; and may be operatively coupled to a thermistor 522 for sensing the temperature of the water 14. Microprocessor 504 may include an "on" indication and/or a "battery low" indication through LEDs 512. Microprocessor may also be operatively coupled to a standby button 516. Upon detecting certain potentially unsafe conditions, microprocessor 504 may be configured to activate an alert device 518, which may produce one or more visual, audible, tactile, and/or other notifications associated with the detected potentially unsafe condition. For example, alert device 518 may comprise a speaker, buzzer, light, and/or other similar notification devices. Some example embodiments may comprise a radio link 520 (e.g., a transmitter and/or a receiver), which may be configured to transmit notifications (e.g., notifications associated with potentially unsafe conditions) and/or other data (e.g., status messages) to one or more remote units 200 and/or to receive data (e.g., information and/or commands) from one or more remote unites 200. For example, commands may active and/or deactivate the bathtub alarm system.

The embodiment of FIG. 8 may operate as follows. A parent may place the monitor unit 700 in the tub 12 for example. As the tub 12 is filled with water 14, the water sensor 520 will detect the water and upon such detection, the processor 504 will turn the monitor 700 on, or activate the monitoring functionalities. When the tub 12 is drained, the sensor 520 may detect the absence of water and cause the processor 504 to turn the monitor 700 off. When the monitor 700 is activated, there may be a delay cycle programmed in before the alarm becomes active (armed). In the meantime, the parent may place the child in the tub 12 (or the child may already be in the tub as the water is filling the tub). Once the monitor 700 arms, activity from the child 16 within the tub may be detected by the accelerometer 531. As long as the child remains active, the alarm 518 will not sound. If the processor 504 determines that the child's activity has stopped based upon signals from the accelerometer, the processor 504 may be configured to trigger the audio alarm 518 and/or transmit information via radio transmitter 520 to the remote unit 200, which may in response emit an audio alert 218.

As the child plays in the bathtub 12, the child's movements generate small motion waves. In a detailed exemplary embodiment, as these motion waves move the accelerometer, the movements generate a series of signals to the microprocessor 504. The processor 504 monitors these signals as movements. When the processor 504 observes a signal (movement) it resets a 60-second timer. If the processor 504 does not see a signal/movement within the 60-second time window, it starts an alarm sequence. The alarm sequence is a sequence of beeps (emitted by the audio alert 518, for example) and quiets that increase in volume and frequency as the alarm continues. The alarm is designed to alert the parent with increasing urgency while not scaring the child with a sudden very loud alarm. Depending upon the level of urgency, movement from the child can resent the alarm sequence and return the processor 504 to monitor mode. By pushing the standby button 516, the processor 504 will be in stand-by mode for 60 seconds (monitor 700 is on, but not detecting movement). Pushing the stand-by button 516 during an alarm sequence will reset the alarm sequence and place the monitor 700 in stand-by mode.

In the current embodiment, the monitor 700 may also serve as a thermometer and temperature alarm. A precision thermistor 522 changes resistance according to the temperature of the bathwater 14. The processor 504 monitors this resistance, and displays the associated temperature on an LCD display 528. Further, if the processor 504 senses that a temperature above a predetermined threshold, such as 100° F., the processor 504 may trigger a high temperature alarm to be emitted by the audio alert 518 and/or by the remote unit's 200 audio alert 218. A jumper may be provided to allow the temperature monitor to switch between Fahrenheit and Centigrade measurements.

Figure 9:
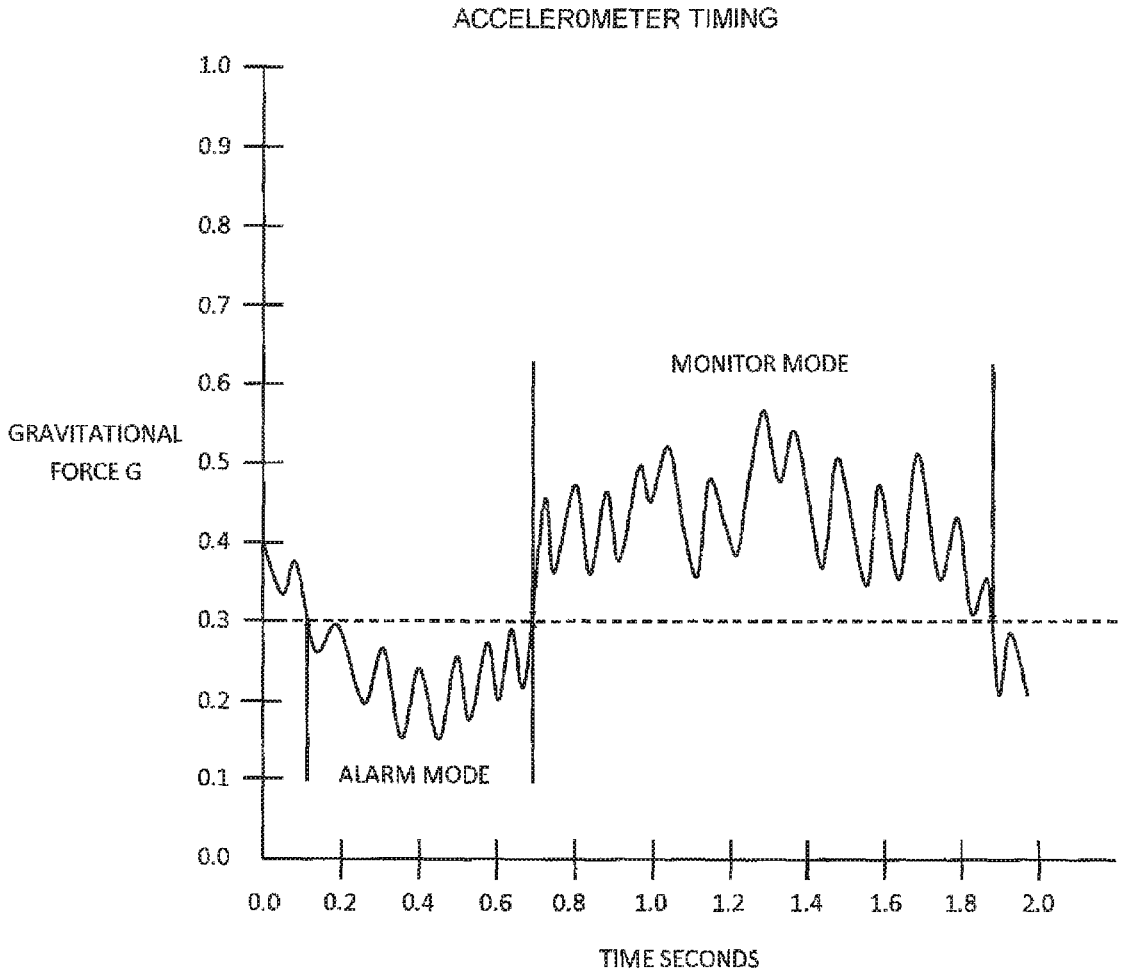
FIG. 9 is an example plot of voltage over time according to an embodiment of the current disclosure.

FIG. 9 is an example plot of gravitational force over time. As discussed above, when the sampled gravitational force is below a minimum threshold (e.g., 0.3 gs), an example embodiment may be in an alarm mode. When the sampled gravitational force is above a minimum threshold, (e.g., 0.3 gs) an example embodiment may be in a monitor mode.

Figure 10:
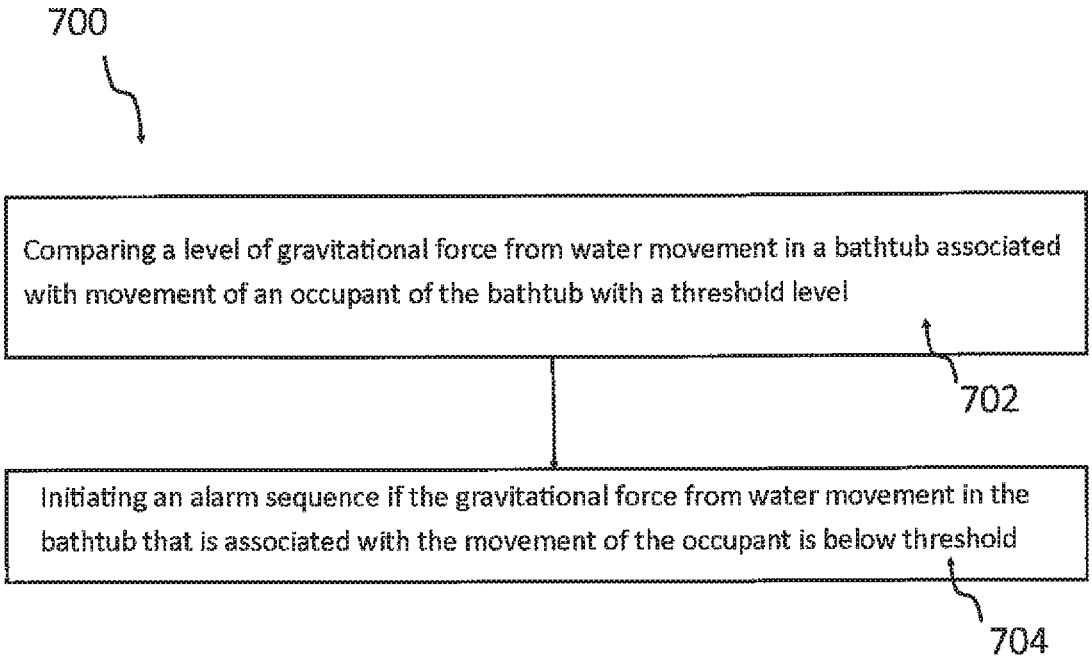
FIG. 10 is a flow chart example method of operating a bathtub alarm according to at least some embodiments of the present disclosure.

FIG. 10 is a flow chart of an example method 700 of operating a bathtub alarm according to at least some embodiments of the present disclosure. Method 700 may include an operation 702, which may include comparing a level of gravitational force from water movement in a bathtub associated with movement of an occupant of the bathtub with a threshold level. Operation 702 may be followed by operation 704, which may include initiating an alarm sequence if the level of the gravitational force from water movement in the bathtub that is associated with the movement of the occupant is below the threshold.

While example embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

What is claimed is:

1. A monitor system for a tub, comprising:

a sensing circuit, including a transducer configured to be at least partially immersed in water contained in a tub, the transducer comprising an accelerometer configured to sense a change in gravitational force attributable to movement of a person situated within the water contained in the tub, the sensing circuit providing an output signal;

a microprocessor operatively coupled to the sensing circuit to receive the output signal and configured to process the output signal to determine if movement of the person situated within the water contained in the tub has been sensed within a predetermined time period and to initiate an alarm sequence if movement of the person situated within the tub has not been sensed within the predetermined time period; and an alert device operatively coupled to the microprocessor for selective activation of an alarm by the microprocessor.

2. The monitor system of claim 1, wherein the change in gravitational force is one of strength, amplitude or frequency of gravitational force.

3. The monitor system of claim 1, wherein the change in gravitational force is a change in the average gravitational force over a period of time.

4. The monitor system of claim 1 further comprising a water sensor for sensing that the monitor system is immersed in the water.

5. The monitor system of claim 1, wherein the microprocessor is configured to initiate the alarm sequence if the accelerometer outputs data indicative of the gravitational forces within the water contained in the tub being below a predetermined value.

6. The monitor system of claim 1, wherein the microprocessor includes a timer that is re-set each time movement of the person situated within the tub has been sensed and that activates the alarm sequence upon timing out before movement of the person situated within the tub has been sensed.

7. The monitor system of claim 1, wherein the alert device increases at least one of volume of the alarm and frequency of the alarm as the alarm sequence continues.

8. The monitor system of claim 1, wherein the microprocessor is further configured to re-set the alarm sequence upon at least one of: (a) the microprocessor sensing movement of the person situated within the tub; and (b) upon the microprocessor sensing that a stand-by button, operatively coupled to the microprocessor, has been activated by a user.

9. The monitor system of claim 1, wherein the alert device is in a remote unit coupled to the microprocessor by a data link.

10. The monitor system of claim 1, further comprising a temperature sensor for sensing a temperature of the water within the tub and providing the temperature to the microprocessor.

11. The monitor system of claim 10, further comprising a display device operatively coupled to the microprocessor, wherein the microprocessor is further configured to control the display device to display the current temperature of the water contained in the tub as sensed by the temperature sensor.

12. The monitor system of claim 10, wherein the temperature sensor includes a thermistor.

13. The monitor system of claim 10, wherein if the microprocessor senses that the temperature received from the temperature sensor is above a predetermined value, the microprocessor activates the alert device to generate a high temperature alarm.

14. The monitor system of claim 10, further comprising a jumper provided to allow the temperature sensor to switch between Fahrenheit and Centigrade measurements.

15. The monitor system of claim 1, wherein the transducer is further configured to at least one of emit and detect sound in the water contained in the tub.

16. The monitor system of claim 15, wherein the transducer is configured to emit ultrasound into the water contained in the tub.

17. The monitor system of claim 16, wherein the ultrasound creates a standing wave in the water contained in the tub, and the microprocessor is configured to filter sound detected by the transducer and associated with movement within the tub from a carrier frequency.

* * * * *